US006098565A

United States Patent [19]

O'Neil, Sr. et al.

[11] Patent Number: 6,098,565

[45] Date of Patent: Aug. 8, 2000

[54] RETRIEVABLE VESSEL ANCHOR WITH RELIABLE GRASPING MECHANISM

[76] Inventors: Thomas E. O'Neil, Sr., P.O. Box 217, Odin, Ill. 62870; Thomas E. O'Neil, Jr., 8740 S. Kenton Ave., Hometown, Ill. 60456

[21] Appl. No.: 09/283,430

[22] Filed: Apr. 1, 1999

[51] Int. Cl.[7] ..... B63B 21/46

[52] U.S. Cl. ..... 114/294; 114/299

[58] Field of Search ..... 114/294, 295, 114/297, 299, 300, 301, 311

[56] References Cited

U.S. PATENT DOCUMENTS 2,239,889 4/1941 Hobbs ..... 114/294

5,353,731 10/1994 Richter ..... 114/299

5,819,681 10/1998 Barnes et al. ..... 114/294

5,934,219 8/1999 Poiraud ..... 114/294

*Primary Examiner*—Stephen Avila

*Attorney, Agent, or Firm*—James Coffing

[57] ABSTRACT

A vessel anchor includes a body having a first cylindrical member and a second cylindrical member. The second cylindrical member is disposed substantially within the first cylindrical member. The vessel anchor further has a retention slide bar for affixing an anchor line. The first cylindrical member has at least one spaded edge and the second cylindrical member has a mass greater than the first cylindrical member.

18 Claims, 2 Drawing Sheets

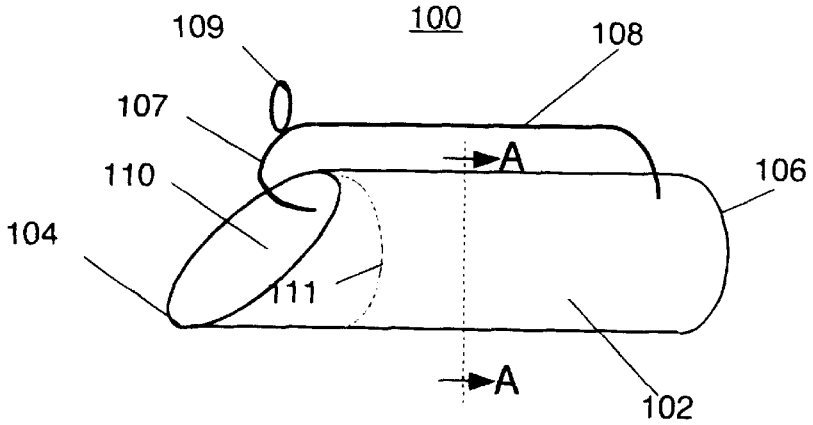
FIG. 1
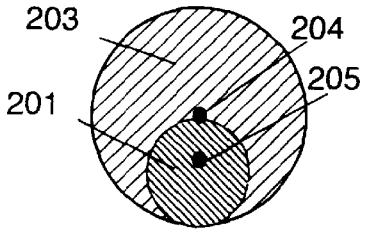
FIG. 2-A
(section A-A)
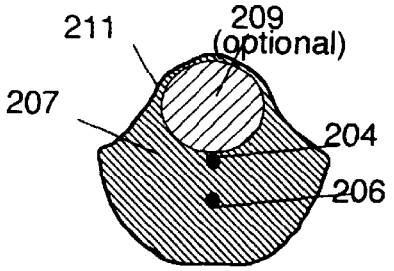
FIG. 2-B
(section A-A)
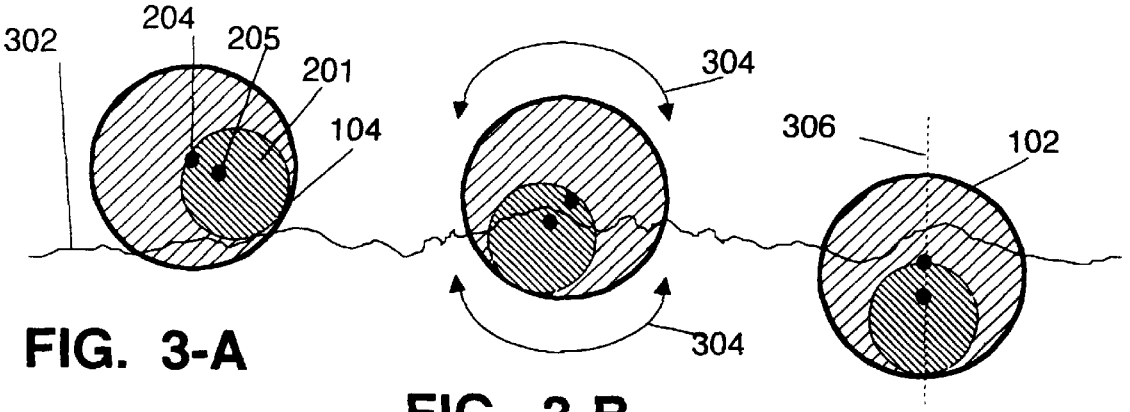
FIG. 3-A
FIG. 3-B
FIG. 3-C FIG. 4-A
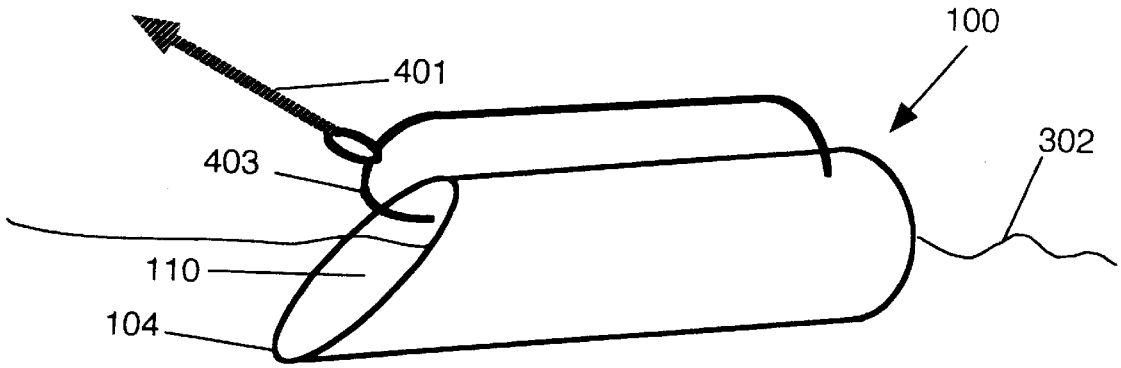
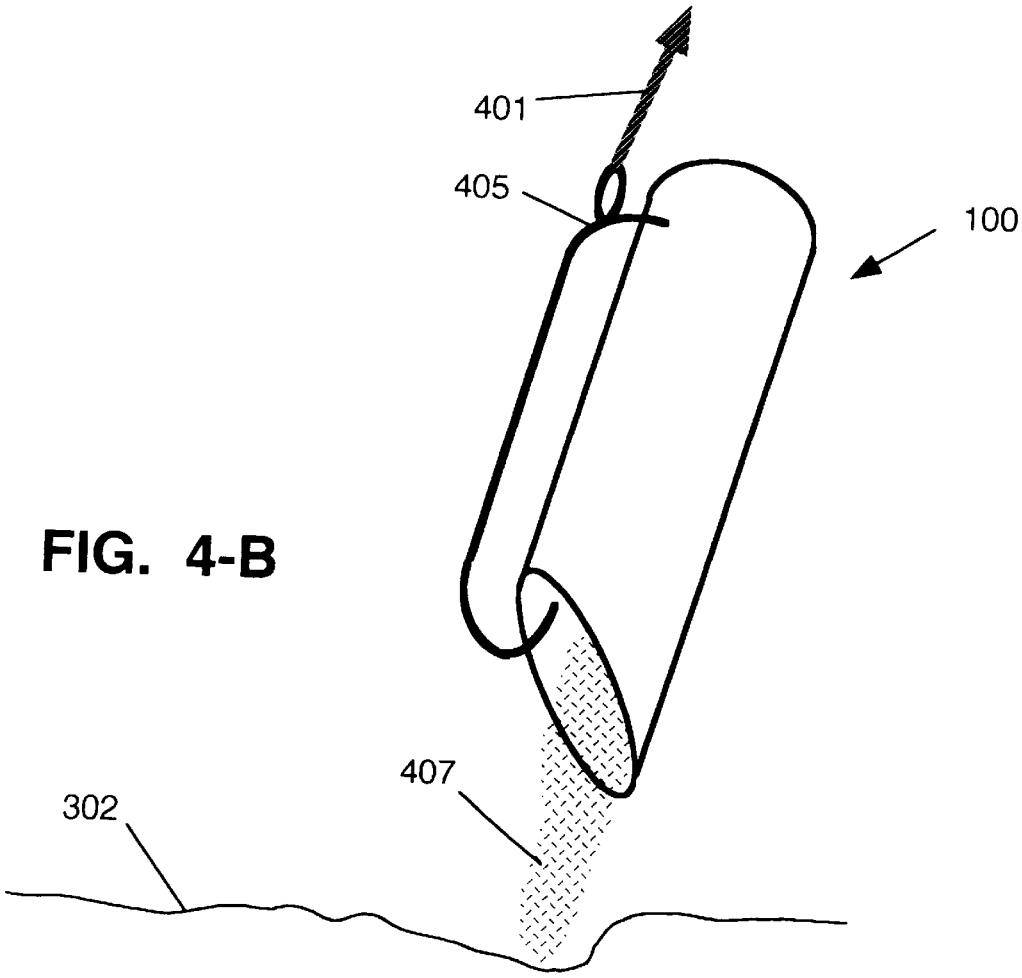
FIG. 4-B

RETRIEVABLE VESSEL ANCHOR WITH RELIABLE GRASPING MECHANISM

FIELD OF THE INVENTION

The present invention relates generally to a vessel (e.g., boat) anchor, and in particular to a vessel anchor that is advantageously designed for easy retrieval and having a spaded end to optimize its grasping ability.

BACKGROUND OF THE INVENTION

Portable vessel anchors are known to include a heavy body, a retention mechanism and a grasping mechanism. This arrangement allows for the anchor to sink into the water and reach the bottom surface, where the grasping mechanism serves to cling to the bottom, thereby holding the vessel in place. The retention mechanism is used to attach an anchor line (e.g., rope, chain) for retrieval purposes. Many designs have been employed to ensure that the grasping mechanism is sufficient to hold the vessel in a stable position on the water's surface. Other requirements demand that the anchor be made sturdy enough to withstand its rigorous use, heavy enough to find a suitable anchoring position on the bottom surface, and small enough to be stored safely and effectively on the vessel during non-use.

Several problems of boat anchors have not yet been completely overcome. Most significant among these problems involves the retrieval of the anchor after use. Today's anchors suffer from one of two opposing design flaws: the grasping mechanism is either insufficient to effectively hold the vessel to the bottom surface, or the grasping mechanism is such that, when the anchor is being retrieved, the anchor snags on anything in its path. Obviously, the first anchor is not suitable for reliable anchoring, as the anchor tends to become dislodged from the bottom surface prematurely. The second anchor, while it performs better than the first anchor during use, is often impossible to retrieve, as it tends to get caught in rock piles, seaweed patches, and the like. Many anchor designs have been employed that tries to solve these conflicting design requirements, without complete commercial success.

Prior art boat anchors include so-called "mushroom" anchors, claw anchors, Danforth anchors and Chene anchors. Several weaknesses are evident in these anchors, making them unsuitable for a wide variety of uses and under varying conditions. For example, mushroom anchors are not designed for use in securing heavier vessels, as the grasping power is not very great. As a result, under unexpected conditions such as high winds or strong currents (when it is most important that the vessel be stabilized), the anchor fails and the vessel is sent adrift.

On the other hand, the traditional claw anchor design, while much better than the mushroom anchor for grasping ability, tends to snag on seaweed, rocks, or other such impediments in the water during retrieval. As a result, the claw anchor is often lost when the vessel pulls so hard on the anchor line as to break it from the anchors retention mechanism.

Another problem with prior art boat anchors is that their construction material is typically much harder than the exterior surface of the vessel being anchored. Claw anchors are commonly made of a hardened steel, which can damage (scratch, or puncture) the side of the vessel during the anchor's ingress to or egress from the water. Some anchors are coated with a protective plastic, but this often becomes damaged or torn off after extended use.

Accordingly, there exists a need for a portable vessel anchor that is not constrained by the shortcomings of the prior art. In particular, there is a need for a vessel anchor with superior grasping ability that does not tend to snag on objects during retrieval. Moreover a vessel anchor that was constructed of such a material that would not be harmful to an exterior vessel surface would be an improvement over the prior art.

BRIEF DESCRIPTION OF THE DRAWINGS

FIG. 1 shows a retrievable vessel anchor, according to the invention;

FIGS. 2A–2B show alternate embodiments of a cross-section of the vessel anchor shown in FIG. 1;

FIGS. 3A–C show how the spaded end of the vessel anchor shown in FIG. 1 is advantageously used to securely grasp a bottom surface, according to a preferred embodiment of the present invention; and FIGS. 4A–B illustrate two positions in which the vessel anchor shown in FIG. 1 is advantageously employed to grasp a bottom surface and release from the bottom surface for easy retrieval.

DETAILED DESCRIPTION OF A PREFERRED EMBODIMENT

The present invention encompasses a portable vessel (e.g., boat, jet-ski) anchor that has a highly reliable grasping mechanism and is easily retrievable. In a preferred embodiment, the vessel anchor comprises a first cylindrical member and a second cylindrical member disposed substantially within the first cylindrical member. The vessel anchor further includes a retention slide bar and a retention member that slides along the retention slide bar, depending on the engagement position of the vessel anchor. In a preferred embodiment, the first cylindrical member of the vessel anchor has a spaded end, and the second cylindrical member has a mass greater than the first cylindrical member. These features act in concert to provide an improved grasping ability, in accordance with the invention as later described.

The present invention can be best described using the illustrations set forth in FIGS. 1–4. FIG. 1 shows a vessel anchor 100, in accordance with the present invention. Such vessel anchors can be employed in various applications, depending on their size and weight, such as anchoring watercraft ranging from small jet-skis to larger boats. In a preferred embodiment, the vessel anchor is manufactured using a plastic housing 102, made up of a first cylindrical member. Cylindrical member 102 has a spaded end 104 and a non-spaded end 106. In a preferred embodiment, the spaded end 104 includes a rounded profile having an apex at the geometric bottom of the first cylindrical member 102, as shown. A retention slide bar 108 is disposed between the spaded end 104 and the non-spaded end 106, running substantially along a lengthwise dimension of the vessel anchor and linearly aligned with the apex of spaded end 104, as shown. The retention slide bar 108 preferably has a semi-circular curved end 107 located near the spaded end 104, as shown. A retention member (e.g., ring) 109 is coupled to the retention slide bar 108 and serves to slidably affix an anchor line to the vessel anchor 100.

As shown in FIG. 1, the spaded end 104 is preferably constructed in such a way as to form a shovel mechanism 110, whereby the first cylindrical member 102 is hollow from the apex of the spaded end 104 to a solid portion 111 of the vessel anchor. In this manner, the present invention allows the weight distribution of the solid portion 111 (as later described with reference to FIG. 2) and the spaded end 104 to act in concert, thereby providing an improved grasping capability. The solid portion 111 can be constructed in a variety of ways, as depicted by reference to cross-section A—A, as next described.

FIG. 2A shows a cross-section A—A of the vessel anchor shown in FIG. 1, according to a preferred embodiment of the present invention. As shown, a second cylindrical member 201 is disposed within the first cylindrical member 102. A filler material 203 is disposed between an outer wall of the second cylindrical member 201 and an inner wall of the first cylindrical member 102. In a preferred embodiment, the first cylindrical member 102 is hollow and formed of a rigid plastic material, such as acrylonitrile butadiene styrene (ABS), having a diameter in the range of two (2) to eight (8) inches, and ranging in length from six (6) inches to 18 inches. Similarly, the second cylindrical member 201 is preferably a solid bar formed of hot-rolled steel (e.g., formed from molten iron pellets), but could be any heavy metal that is suitable for this type of form and fabrication. Preferred dimensions of the second cylindrical member 201 range from four (4)–16 inches in length, and from one (1)–seven (7) inches in diameter, depending on the desired weight of the vessel anchor. The filler material 203 is used primarily to secure the position of the second cylindrical member 201 relative to the first cylindrical member 102. In a preferred embodiment, the filler material 203 comprises a foam material, such as a closed-cell polyurethane. In practice, it is only necessary that the filler material 203 have a relative density that is less than that of the second cylindrical member 201, so as to increase the distance between the geometric center 204 and the gravitational center 205 of the vessel anchor 100. As shown, the gravitational center 205 of the arrangement shown in FIG. 2-A is substantially below its geometric center. It is this relationship of densities and weight distribution within the vessel anchor 100 that provides the advantageous grasping capability, by affecting a rocking motion as the vessel anchor 100 seeks to attain a state of equilibrium when it comes to rest on the bottom surface. This rocking motion allows the vessel anchor to effectively dig into the bottom surface, as later described with reference to FIG. 3, and yields a grasping capability that is vastly superior to that of prior art anchors.

It should be noted that, according to the invention, the weight of the vessel anchor can be varied simply by increasing the diameter of the second (solid) cylindrical member 201. For ease of manufacturing, the dimensions (length and diameter) of the first (hollow) cylindrical member 102 and the lengthwise dimension of the second (solid) cylindrical member can remain constant, independent of the final weight of the vessel anchor. That is, by simply increasing the diameter, and the corresponding circumference, of the second cylindrical member 201, the overall weight of the vessel anchor 100 can be increased. According to the invention, anchor vessels can be readily manufactured in the range of 6–40 pounds by simply altering the circumferential dimension of the second cylindrical member 201. This feature allows the same basic vessel anchor design to be used in a wide variety of service applications, ranging from anchoring a small aluminum fishing boat to anchoring a medium-to-large cruising boat, by simply varying the solid member's circumference for increased weight.

FIG. 2-B shows a cross-section A—A of the vessel anchor shown in FIG. 1, in accordance with an alternate embodiment of the present invention. In this alternate embodiment, the solid member is not in the form of a cylinder, but rather in a shape substantially as shown, the essential feature being that the gravitational center 206 of the mass is lower than the geometric center 204 of the arrangement. In particular, a solid mass 207 might be formed of hot-rolled steel, similar to the arrangement shown in FIG. 2-A. Additionally, an optional filler material 209 might be used to lower the gravitational center 206 of the vessel anchor. In this alternate embodiment, the weight distribution of the mass requires that the vessel anchor, to attain equilibrium, must undergo the same sort of rocking motion affected by the cylindrical arrangement shown in FIG. 2-A. That is, when the vessel anchor settles on the bottom surface, it attempts to reach equilibrium, rocking back and forth in a circular motion, which provides the digging motion for the spaded end 104, in accordance with the invention. In this alternate embodiment, a protective coating 211 can be used to prevent the hard solid mass 207 from damaging the vessel being anchored.

FIGS. 3A–C show how the vessel anchor 100 digs into a bottom surface during operation, in accordance with the invention. Referring to FIG. 3-A, which shows the preferred cylindrical arrangement of FIG. 2-A, the vessel anchor 100 reaches a bottom surface 302 in a first position. It is noted that the solid cylindrical member 201—and hence the gravitational center 205—is positioned off to one side with respect to the geometric center 204 of the vessel anchor. Because of the unstable weight distribution in this position, the spaded end 104 begins to dig into the bottom surface 302, trying to reach a state of equilibrium, where the geometric center 204 and the gravitational center 205 are substantially aligned in the vertical direction.

Referring now to FIG. 3-B, the vessel anchor 100 undergoes a rocking motion 304, as shown, in an attempt to reach a state of equilibrium (i.e., where the gravitational center of the vessel anchor aligns vertically with the geometric center thereof). This rocking motion 304 translates into a vigorous digging action by the spaded end 104 of the vessel anchor, until equilibrium is reached, as shown in FIG. 3-C. This digging action is advantageously employed, in accordance with the present invention, to provide a more reliable grasping mechanism, as the vessel anchor 100 automatically digs itself deeper into the bottom surface 302, until the geometric and gravitational centers are aligned 306. Tests have indicated that the combination of the vessel anchor's weight and the distribution of that weight about its geometric center accounts for the superior grasping capability of the present invention.

FIG. 4-A shows a perspective view of the vessel anchor 100 in the position depicted in FIG. 3-C. The anchor line (e.g., rope, chain) 401 is shown in a taught position, as the retention member 109 is pulled to an engaging position 403 at the semi-circular curved end of the retention slide bar 108. By pulling in the direction shown, the boat is firmly anchored to the bottom surface 302 as the spaded end 104 digs in response to the rocking motion (304 shown in FIG. 3-B). The shovel mechanism 110 firmly grasps the bottom surface 302 in this engaged position. As expected, by using a heavier vessel anchor (advantageously accomplished by simply increasing the diameter/circumference of the second cylindrical member—201 shown in FIG. 2A), a deeper, more reliable grasping action is realized.

FIG. 4-B shows another advantageous feature of the anchor vessel 100, in accordance with the present invention. When the operator of the vessel being anchored desires to move (i.e., "take-up anchor"), a simple procedure is used. By moving the vessel in a direction opposite the spaded end 104 of the vessel anchor 100, the retention member 109, attached to anchor line 401, slides along the retention slide bar to a retrieval (or disengaged) position. In this position, the vessel anchor 100 can be easily dislodged from the bottom surface 302 and retrieved using the anchor line 401, as shown. As the vessel anchor is being retrieved, debris 407 that has accumulated in the shovel mechanism (110 shown in FIG. 4-A) is released back to the bottom surface 302. Thus, the overall load that the vessel anchor puts on the boat pulling on the anchor line 401 is significantly reduced. Moreover, because the grasping mechanism faces away from the direction of retrieval, as shown, the disengaged vessel anchor 100 doesn't snag on other obstacles in its path during the retrieval process, unlike prior art vessel anchors.

In the foregoing manner, the present invention advantageously provides for improved grasping by a vessel anchor to a bottom surface. Further, the vessel anchor of the present invention can be easily retrieved, is adaptable to a wide variety of applications with minimal design changes, and can be easily and safely stored on the vessel during non-use.

What is claimed is:

1. A vessel anchor, comprising:

a body that includes a first cylindrical member and a second cylindrical member disposed substantially within said first cylindrical member; and a retention slide bar, running substantially along a lengthwise dimension of said body;

whereby said first cylindrical member has at least one spaded end, wherein said spaded end comprises an edge having an apex, wherein said retention slide bar is linearly aligned with said apex, and whereby said second cylindrical member has a mass greater than said first cylindrical member.

2. The vessel anchor of claim 1, further comprising:

filler material disposed substantially between said first cylindrical member and said second cylindrical member.

3. The vessel anchor of claim 2, wherein s aid filler material comprises a foam-based material.

4. The vessel anchor of claim 1, wherein a semi-circular curved end of said retention slide bar is attached to said body substantially near the spaded end.

5. The vessel anchor of claim 4, wherein an end of the retention slide bar opposite the semi-circular curved end is further attached to said body substantially near an end opposite the spaded end.

6. The vessel anchor of claim 1, further comprising a retention member, operably coupled to said retention slide bar.

7. The vessel anchor of claim 1, wherein said first cylindrical member comprises a plastic material.

8. The vessel anchor of claim 1, wherein said second cylindrical member comprises a hot-rolled steel bar.

9. The vessel anchor of claim 8, wherein said hot-rolled steel bar has a lengthwise dimension that is less than a lengthwise dimension of said first cylindrical member.

10. The vessel anchor of claim 1, wherein the vessel anchor's weight is determined substantially by a circumferential dimension of said second cylindrical member.

11. A vessel anchor, comprising:

a cylindrical body that includes a first cylindrical member and a second cylindrical member disposed substantially within said first cylindrical member;

a filler material disposed between an inside wall of a said first cylindrical member and an outside wall of said second cylindrical member;

a retention slide bar fixably attached to a first end of said cylindrical body and to a second end of said cylindrical body;

a retention member, operably coupled to said retention slide bar;

whereby said first cylindrical member has at least one spaded end, wherein said spaded end comprises an edge having an apex, wherein said retention slide bar is linearly aligned with said apex, and whereby said second cylindrical member has a mass greater than said first cylindrical member.

12. The vessel anchor of claim 11, wherein the first cylindrical member comprises a hollow plastic material.

13. The vessel anchor of claim 11, wherein the second cylindrical member comprises a solid hot-rolled steel bar.

14. The vessel anchor of claim 11, wherein the filler material comprises a foam material.

15. A vessel anchor, comprising:

a solid body having a mass distribution such that its gravitational center is lower than its geometric center, said solid body further having a spaded end and a non-spaded end, wherein said spaded end comprises an edge having an apex a retention slide bar fixably attached near said spaded end and further attached near said non-spaded end, wherein said retention slide bar is linearly aligned with said apex, and a retention member operably coupled to said retention slide bar.

16. The vessel anchor of claim 15, further comprising a protective material disposed on an exterior surface of said solid body.

17. The vessel anchor of claim 15, wherein said solid body comprises a first material having a relative density value substantially greater than one.

18. The vessel anchor of claim 17, wherein said solid body further comprises a second material having a relative density substantially lower than the relative density of said first material.

* * * * *